US007263742B2

(12) United States Patent
Valentini

(10) Patent No.: US 7,263,742 B2
(45) Date of Patent: Sep. 4, 2007

(54) MOBILE UNIT WITH DRAWERS AND DETACHABLE DUST SUCTION SYSTEM

(76) Inventor: Guido Valentini, Via Gioberti, 2-20123 Milan (IT)

( * ) Notice: Subject to any disclaimer, the term of this patent is extended or adjusted under 35 U.S.C. 154(b) by 427 days.

(21) Appl. No.: 10/680,752

(22) Filed: Oct. 7, 2003

(65) Prior Publication Data

US 2004/0103494 A1 Jun. 3, 2004

(30) Foreign Application Priority Data

Nov. 28, 2002 (IT) ..... MI2002A002527

(51) Int. Cl.
*A47L 9/00* (2006.01)

(52) U.S. Cl. ..... 15/323; 15/327.2; 15/352

(58) Field of Classification Search ..... 15/339, 15/323, 352, 327.2; 206/576; 312/249.8, 312/249.11, 111, 223.6
See application file for complete search history.

(56) References Cited

U.S. PATENT DOCUMENTS

| | | | | | |
|---|---|---|---|---|---|
| 2,042,387 | A * | 5/1936 | Cobb | ..... | 15/323 |
| 2,528,872 | A * | 11/1950 | Dick | ..... | 15/323 |
| 3,401,420 | A * | 9/1968 | Lofgren | ..... | 15/323 |
| 3,891,230 | A | 6/1975 | Mayer | | |
| 4,989,291 | A * | 2/1991 | Parent | ..... | 15/323 |
| 5,915,438 | A * | 6/1999 | Winters et al. | ..... | 15/323 |
| 6,230,361 | B1 * | 5/2001 | Griffin | ..... | 15/327.2 |
| 7,000,287 | B2 * | 2/2006 | Valentini | ..... | 15/323 |

FOREIGN PATENT DOCUMENTS

| | | |
|---|---|---|
| DE | 73 34 435 U | 1/1974 |
| DE | 89 12 526 U | 2/1990 |
| DE | 100 63 022 C | 6/2002 |
| EP | 0 377 100 A | 7/1990 |
| EP | 1 321 247 A2 | 6/2003 |
| IT | MI2001U000676 | 12/2001 |
| IT | MI2002U000293 | 6/2002 |
| WO | WO 01 24941 A | 4/2001 |

OTHER PUBLICATIONS

English translation of DE8912526-7.*

* cited by examiner

*Primary Examiner*—Theresa T. Snider
(74) *Attorney, Agent, or Firm*—Gwendolyn R. Acker Wood; Arnold B. Silverman; Eckert Seamans Cherin & Mellott, LLC

(57) ABSTRACT

The following invention refers to a mobile unit comprising a hollow container (5) fit for housing in a sliding manner at least one drawer (7), and a case (16), which can be detached in virtue of suitable hooking/unhooking means (15), containing a dust suction device. Said mobile unit also comprises additional containers (19) that can be moved and piled on top of each other and on top of said hollow container (5).

5 Claims, 3 Drawing Sheets

MOBILE UNIT WITH DRAWERS AND DETACHABLE DUST SUCTION SYSTEM

CROSS REFERENCE TO RELATED APPLICATIONS

This invention claims priority under 35 U.S.C. 119 from Italian Patent Application No. MI2002A002527, which was filed Nov. 28, 2002 and is incorporated by reference herein.

BACKGROUND OF THE INVENTION

1. Field of the Invention

The present invention refers to a mobile unit with drawers and detachable dust suction system.

2. Description of Related Art

Currently the electric and pneumatic tools used for machining surfaces such as sanding machines, abrasive grinders, drills or other electric tools can be connected to more or less cumbersome devices for the suction of machining dust produced by the tools.

It is clear that for machining jobs of a certain complexity, the overall dimensions of the devices are such that for moving them a mobile unit fitted with wheels is needed that facilitates moving them near the work position.

Sometimes it is necessary to reach areas whose access is difficult (for example attics to be reached with narrow spiral stairs), so if the suction device cannot be separated from the mobile transport unit the areas cannot be worked.

SUMMARY OF THE INVENTION

The object of the present invention is to provide a mobile transport unit comprising a detachable dust suction system, so as to enable the operator to move the above-mentioned unit to any work position and also to access the areas that are difficult to reach.

In accordance with the present invention, this object is achieved by means of a mobile unit, characterised in that it comprises a hollow container fit for housing at least one drawer in a sliding manner, and a case, that can be detached in virtue of suitable hooking/unhooking means, containing a dust suction device.

The mobile unit, preferably fitted with wheels, can also be used for transporting containers of various kinds above the suction device or held between the hollow container and the same suction device, possibly hooked on, as explained further ahead.

BRIEF DESCRIPTION OF THE DRAWINGS

The characteristics and advantages of the present invention will appear evident from the following detailed description of an embodiment thereof, illustrated as a non-limiting example in the enclosed drawings, in which.

DESCRIPTION OF THE PREFERRED EMBODIMENTS

Figure 1:
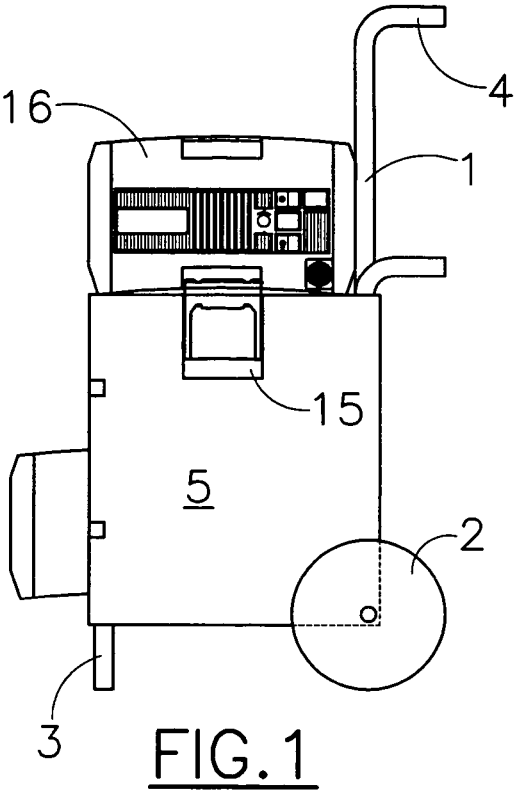
FIG. 1 is a side view of a possible embodiment of the mobile unit according to the present invention.
Figure 2:
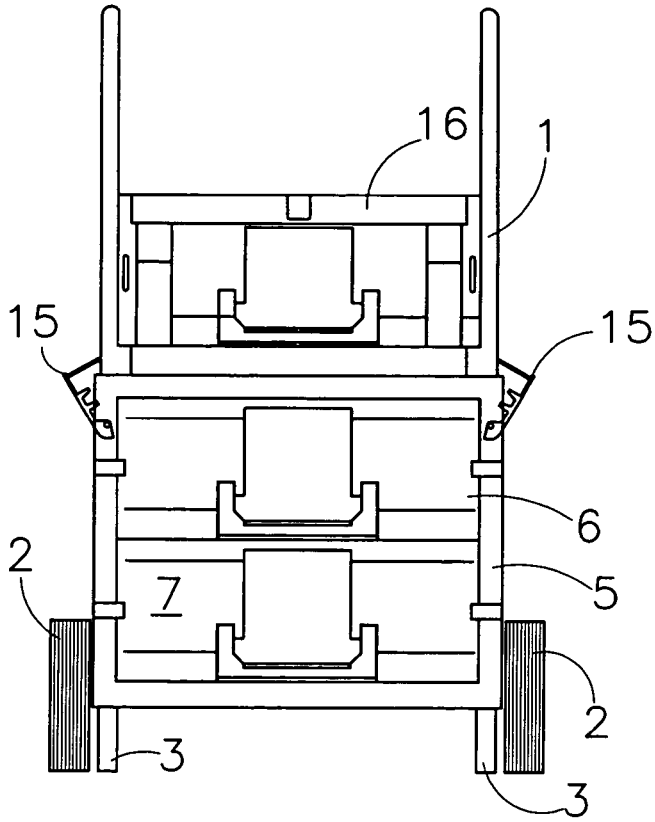
FIG. 2 is a front view of the mobile unit of FIG. 1.
Figure 3:
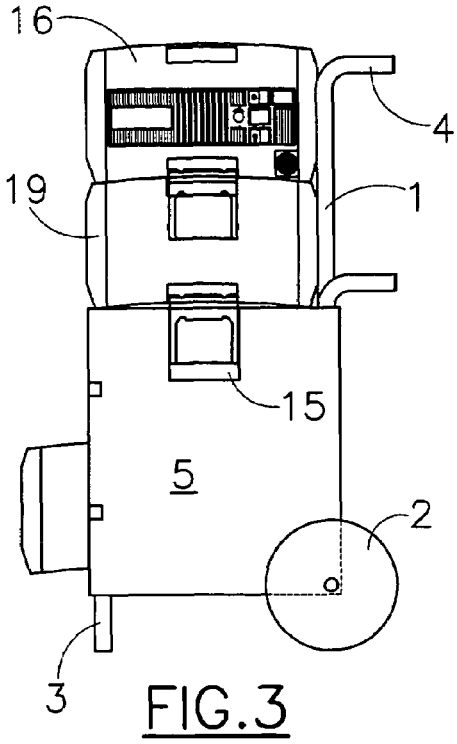
FIG. 3 is a side view of the mobile unit with another container for the collection of the dust positioned under the suction device and with a drawer provided with sockets for the supply of electric or pneumatic power.
Figure 5:
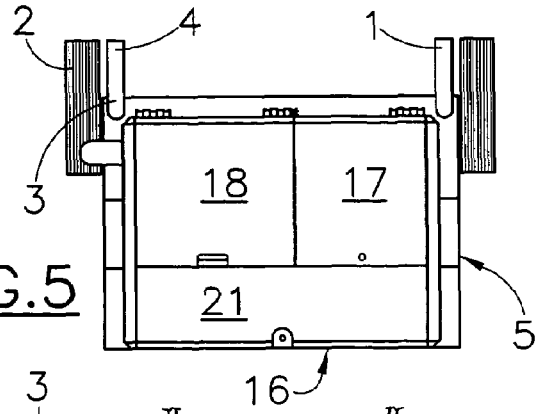
FIG. 5 is a top view of the mobile unit of FIG. 3.

With reference to FIGS. 1-2, a mobile unit is shown according to the present invention. The mobile unit has a trolley 1 fitted with rear wheels 2, front feet 3, an upper handle 4 and a hollow container 5, preferably in a plastic material.

Figure 7:
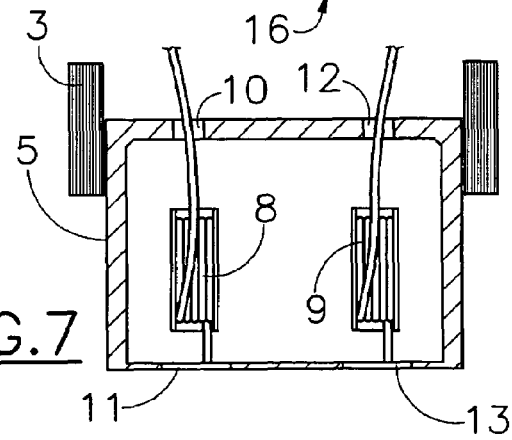
FIG. 7 is a sectional view according to the line VII-VII of the mobile unit of FIG. 4.
Figure 4:
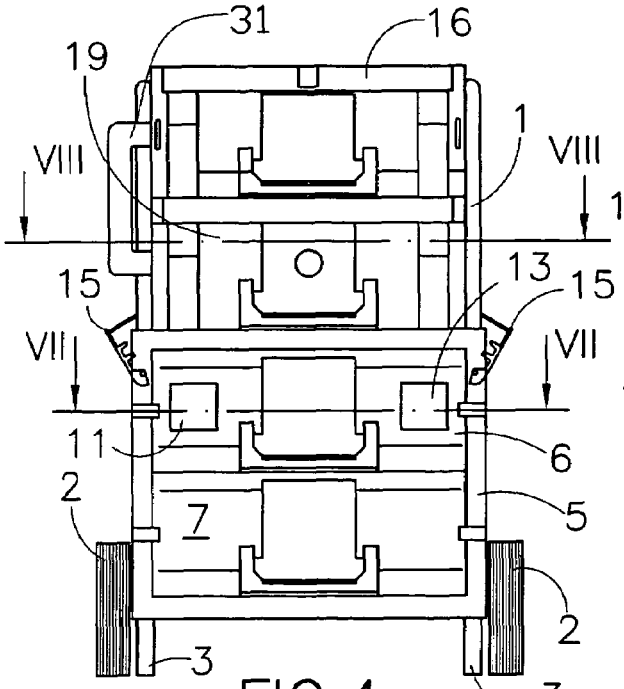
FIG. 4 is a front view of the mobile unit of FIG. 3.
Figure 6:
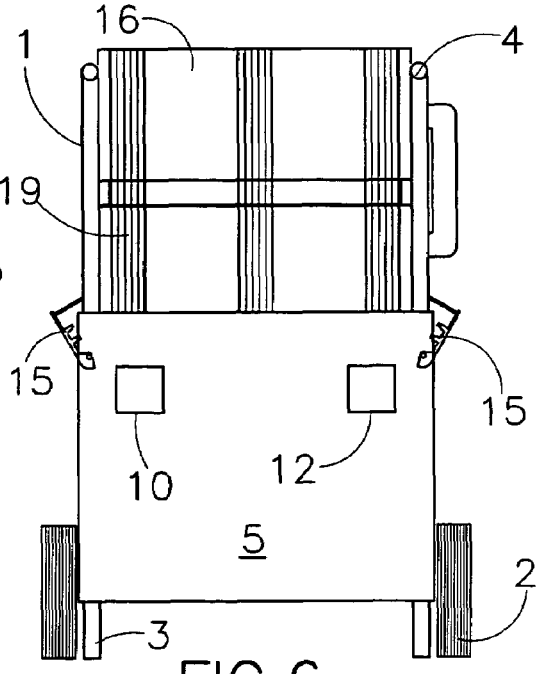
FIG. 6 is a rear view of the mobile unit of FIG. 3.

Inside the hollow container 5 two drawers 6 and 7 are housed in a sliding manner that can be used to contain equipment and electrical and pneumatic material of various kinds. According to the embodiment of FIGS. 3-7, the drawer 6 is fit for containing various types of electrical material or, according to the embodiment of FIGS. 3-7, reels 8 and 9 (FIG. 7) with respective extension cords for supplying power to electrical and pneumatic tools.

The electric cable of reel 8 has one end that comes out from the rear of the container 5 through a hole 10 and can be connected to a fixed electric system by unwinding the reel itself. The electric cable of reel 8 has the other end that is connected to an electric socket 11 provided on the front of the drawer 6 for connection to the tool to be used. In the same manner the compressed air supply tube of reel 9 has one end that comes out of the rear of the container 5 through a hole 12 and can be connected to a compressed air plant by unwinding the reel itself. The compressed air supply tube of reel 9 has the other end that is connected to a pneumatic inlet 13 provided on the front of the drawer 6 for connection to the tool to be used.

Drawer 7 is fit for holding working scraps or can be used for housing the tool to be transported to the work area or for other uses.

Container 5 is preferably provided with side hooks 15 positioned near the upper part of the container 5 for the detachable connection to a case 16 containing a dust suction unit. In this manner the case 16 can be easily transported to the work area.

Figure 8:
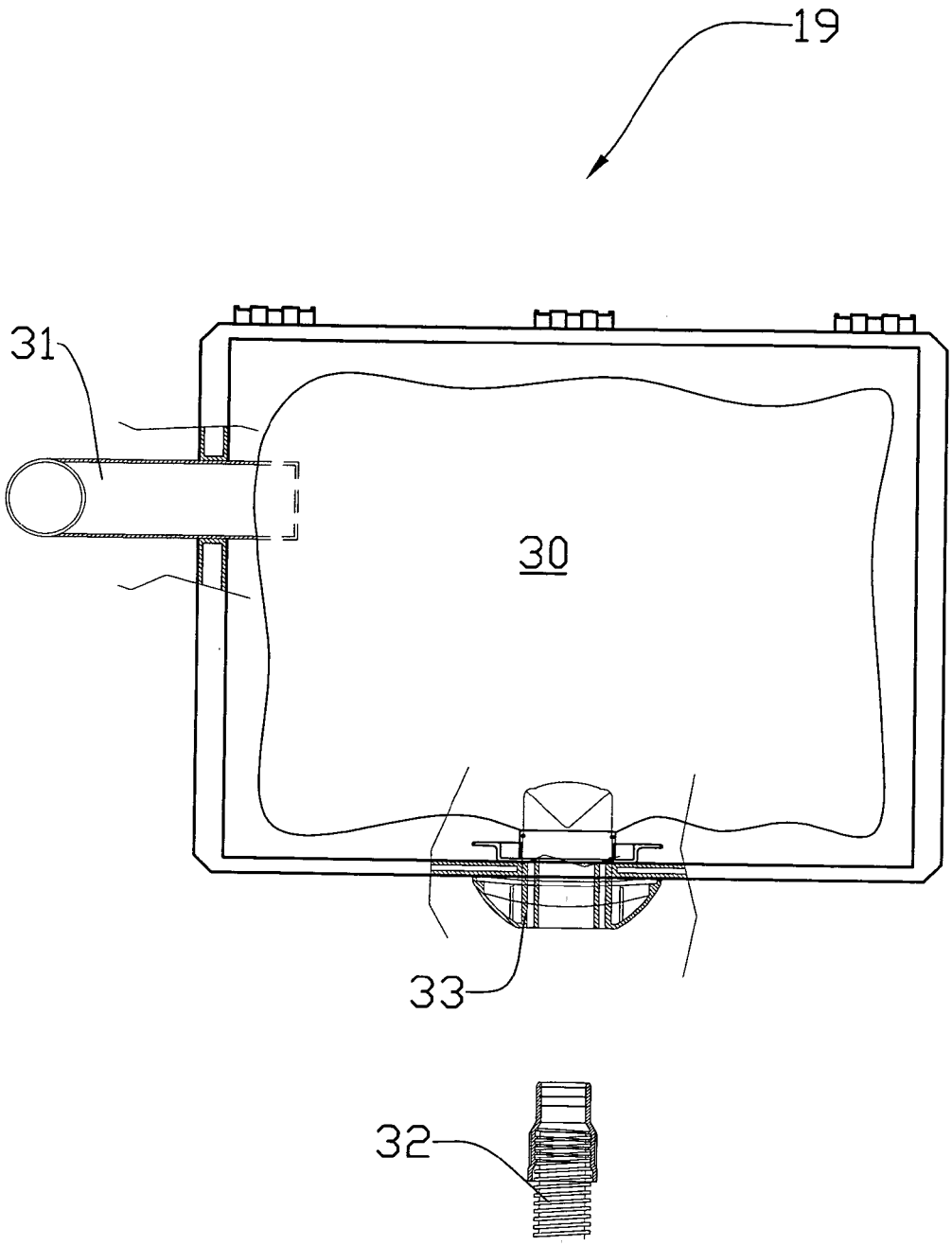
FIG. 8 is a sectional view according to the line VIII-VIII of the mobile unit of FIG. 2.

The case 16 can be made up of a portable suction appliance for electric or pneumatic tool of the type described for example in the Italian utility model application No. MI2001U000676 of the same Applicant, that is comprising at least three compartments; a first compartment 17 with fixed lid houses air suction means, in a second compartment 18 fitted with openable lid there are filtering means and replaceable means for collecting the machining dust contained in the air sucked in and a third compartment 21 that can house the electric or pneumatic tool and/or its accessories. The case 16 can be placed on top of and hooked onto another case 19 (FIGS. 3-4) which in turn is fastened so that it can be detached from the hollow container 5. The additional case 19 can be suitable for containing any object, in particular a portable tool and its accessories, or can constitute an expansion of the suction case 16. In this case, as shown in FIG. 8, it can contain a bag 30 for collecting the dust, which is connected to the case 16 by means of a tube 31 and can be connected to a flexible tube 32 connected to the electric or pneumatic tool. An opening 33 interfaces the bag 30 inside the case 19 with the flexible tube 32 guaranteeing that there are no leakages during suction.

The case 16 and the additional case 19 can also constitute the first container and the second container of a portable appliance as defined, for example, in the Italian utility model application No. MI2002U000293 of the same Applicant.

In conclusion, if the operator has to work a surface positioned in a distant room, he can transfer the whole mobile unit to the working area. If this is difficult to reach, he can detach the cases 16 and 19 (or only 16 if it is provided with a bag for collecting the dust) and go close to the working area without any problems.

The invention claimed is:

1. A mobile unit comprising a hollow container provided with an inner space and with at least one sliding drawer housed in said inner space, an autonomous dust suction case positioned on the top of said hollow container but separated from the inner space thereof, said dust suction case including separate compartments for housing a means for air suction, a means for filtering and a means for replaceable dust collecting, and a means for hooking/unhooking for removably fastening said dust suction case to said hollow container.

2. The mobile unit according to claim 1, wherein said hollow container comprises at least another drawer which contains reels with respective extension cords for supplying electric and pneumatic tools.

3. The mobile unit according to claim 1, wherein additional containers are piled in removable manner on each other and on said hollow container.

4. The mobile unit according to claim 1 wherein said means for replaceable dust collecting comprises an additional case including a compartment for housing a dust collecting bag, said compartment of the additional case being fastened to said main case by a means for hooking/unhooking and communicating with said compartments of the main case through a flexible tube.

5. The mobile unit according to claim 1, wherein said hollow container is provided with wheels.

* * * * *